US007468021B2

(12) United States Patent
Moon

(10) Patent No.: US 7,468,021 B2
(45) **Date of Patent: *Dec. 23, 2008**

(54) COMPACT ELLIPTICAL EXERCISE MACHINE WITH ADJUSTABLE STRIDE LENGTH

(75) Inventor: Daniel R Moon, Riverside, IL (US)

(73) Assignee: True Fitness Technology, Inc., O'Fallon, MO (US)

( * ) Notice: Subject to any disclaimer, the term of this patent is extended or adjusted under 35 U.S.C. 154(b) by 153 days.

This patent is subject to a terminal disclaimer.

(21) Appl. No.: 11/567,377

(22) Filed: Dec. 6, 2006

(65) Prior Publication Data

US 2007/0087905 A1 Apr. 19, 2007

Related U.S. Application Data

(63) Continuation of application No. 11/185,179, filed on Jul. 20, 2005, now Pat. No. 7,182,714, which is a continuation-in-part of application No. 10/636,316, filed on Aug. 7, 2003, now Pat. No. 7,097,591.

(60) Provisional application No. 60/401,638, filed on Aug. 7, 2002.

(51) Int. Cl.
*A63B 71/00* (2006.01)
*A63B 22/04* (2006.01)

(52) U.S. Cl. ..... 482/52; 482/51

(58) Field of Classification Search ..... 482/51, 482/52, 57, 70, 79–80
See application file for complete search history.

(56) References Cited

U.S. PATENT DOCUMENTS

| | | | | |
|---|---|---|---|---|
| 4,786,050 | A * | 11/1988 | Geschwender | 482/57 |
| 6,183,398 | B1 * | 2/2001 | Rufino et al. | 482/57 |
| 6,454,682 | B1 * | 9/2002 | Kuo | 482/52 |
| 6,648,800 | B2 * | 11/2003 | Stearns et al. | 482/52 |
| 6,689,019 | B2 * | 2/2004 | Ohrt et al. | 482/52 |
| 6,835,166 | B1 * | 12/2004 | Stearns et al. | 482/52 |
| 7,052,438 | B2 * | 5/2006 | Eschenbach | 482/52 |
| 7,097,591 | B2 * | 8/2006 | Moon | 482/52 |
| 7,182,714 | B2 * | 2/2007 | Moon | 482/52 |

* cited by examiner

*Primary Examiner*—Steve R Crow
(74) *Attorney, Agent, or Firm*—Lewis, Rice & Fingersh, L.C.

(57) ABSTRACT

An elliptical exercise machine and methods for using the machine where the horizontal length of the stride of the ellipse can be adjusted by the user without the user having to alter the vertical dimension of the ellipse by an equivalent amount. The machine provides for alteration due to the interaction of two arms via a coupler where distance from a rotational axis to the coupler may be adjusted The machine may allow for this adjustment to occur during the performance of an exercise routine.

18 Claims, 8 Drawing Sheets

COMPACT ELLIPTICAL EXERCISE MACHINE WITH ADJUSTABLE STRIDE LENGTH

CROSS REFERENCE TO RELATED APPLICATIONS

This application claims benefit of and is a Continuation of U.S. patent application Ser. No. 11/185,179 filed Jul. 20, 2005 and currently now U.S. Pat. No. 7,182,714, which is in turn a Continuation-in-Part of U.S. patent application Ser. No. 10/636,316 filed Aug. 7, 2003 and now U.S. Pat. No. 7,097,591, which in turn claims benefit of U.S. provisional patent application Ser. No. 60/401,638 filed Aug. 7, 2002. The entire disclosure of all these documents is herein incorporated by reference.

BACKGROUND

1. Field of the Invention

This disclosure relates to the field of elliptical exercise machines. In particular, to elliptical exercise machines which allow for alteration in the shape of the foot path.

2. Description of the Related Art

The benefits of regular aerobic exercise on individuals of any age is well documented in fitness science. Aerobic exercise can dramatically improve cardiac stamina and function, as well as leading to weight loss, increased metabolism and other benefits. At the same time, aerobic exercise has often been linked to damaging effects, particularly to joints or similar structures where the impact from many aerobic exercise activities can cause injury. Therefore, those involved in the exercise industry are continuously seeking ways to provide users with exercises that have all the benefits of aerobic exercise, without the damaging side effects.

Most low-impact aerobic exercises have traditionally been difficult to perform Many low-impact aerobic exercises (such as those performed in water) traditionally require performance either outside or at a gym. Cold weather, other undesirable conditions, and cost can make these types of aerobic exercise unobtainable at some times and to some people. In order to allow people to perform aerobic exercises without having to go outside or to gyms or the like, fitness machines have been developed to allow a user to perform aerobic exercises in a small area of their home.

Many of these machines, however, are either too physically demanding on the user or too complicated to use. In either case, the machine falls into disuse. Recently, a class of machines which are referred to as "elliptical machines" or "elliptical cross-trainers" have become very popular due to their ease of use and their provision of relatively low-impact aerobic exercise.

Generally in these types of machines, a user performs a motion using their legs that forces their feet to move in a generally elliptical motion about each other. This motion is designed to simulate the motion of the feet when jogging or climbing but the rotational motion is "low-impact" compared to jogging or climbing where the feet regularly impact a surface. In an elliptical machine, a user uses a fairly natural motion to instead move their feet through the smooth exercise pattern dictated by the machine. This motion may also be complemented by them moving their arms in a reciprocating motion while pulling or pushing various arms on the machine whose motion is connected to the motion of the feet, and vice-versa.

Currently, the biggest problem with elliptical machines is that the dimensions of the elliptical pathway followed by the user's feet are generally severely limited in size and shape by the design of the machine The elliptical pathway generated by these machines is often created by the interaction of a plurality of different partial motions, and attempts to alter the motion of a user in one dimension generally also alters the motion in another. It is desirable that users have the option to arrange the machine so that the ellipse can be tailored to fit their stride and to change during the exercise, but with machines on the market today, that generally is not possible.

The problem is most simply described by looking at the elliptical motion the feet make when using an elliptical exercise machine. This elliptical motion can be described by the dimensions of the ellipse. Since users generally stand upright on elliptical machines, the user's feet travel generally horizontally relative to the surface upon which the machine rests. This represents the user's stride length or how far they step. Further, the user's feet are raised and lowered relative to the surface as they move through the ellipse. This is the height to which the user's feet are raised. How a user steps depends on the type of action they are performing. A more circular ellipse will often correspond more to the motion made while climbing, a slightly more elongated ellipse is more akin to walking, while a significantly elongated ellipse can be more akin to the motion of running.

As a user's speed on the machine increases or decreases, the resistance imparted by the machine increases or decreases, or simply based on the size of the user, it can be desirable for the machine to alter the type of stride the user is making (by elongating or shortening the stride) to better correspond to a more natural movement. This allows the user to move through a range of different activities during an exercise session, providing for a beneficial workout.

In elliptical machines currently, the size and shape of the ellipse is generally fixed by the construction of the machine. That is, the footrests (the portion of an elliptical machine that will traverse the same ellipse as the user's feet) are generally forced to proscribe only a single ellipse when the machine is used and that ellipse is generally unchangeable. Some machines allow for some alteration of this ellipse, but generally those machines increase both dimensions of the ellipse, not just the horizontal component. That is, the user can adjust the total size of the ellipse, but the ratio of the ellipse's components remains relatively constant.

This arrangement means that many users are not comfortable with the stride of an elliptical machine as it is either too long or too short for their stride. Even if the stride is adjustable, the user may still be uncomfortable. For some users, the stride will be much too short compared to their normal stride and attempts to increase the stride length result in their feet being raised uncomfortably high (e g. turning a walking or jogging exercise motion into more of a climbing motion), while for others the same machine's stride can be much too long (resulting in overstretching of their legs as if they are running all the time). Further, a user may desire to tailor the machine's motion for the general type of exercise they want to perform (e.g., more jogging motion or more climbing motion) and may wish to alter the motion during an exercise session to have a more varied workout.

SUMMARY

Because of these and other problems in the art, described herein, among other things, are elliptical exercise machines where the length of the horizontal dimension (stride) of the ellipse can be adjusted by the user independent of altering the vertical dimension of the ellipse by an equivalent amount This is generally referred to as having an "adjustable stride length"

in the elliptical machine. Further, the machines described herein are generally intended to allow for alteration of the stride length during the exercise or "on-the-fly" so that a user can vary their stride length throughout an exercise to make the exercise more comfortable and to provide for a more varied workout.

Described herein, among other things, is an elliptical exercise machine comprising: a frame; at least two crankshafts rotationally connected to the frame; a rail attached to the crankshafts so that the rail traverses a path in conjunction with the rotation of the crankshafts; a pendulum arm, connected to the frame at a first rotational axis to the frame, and operatively connected to at least one of the crankshafts such that the pendulum arm reciprocates within a first arc segment as the at least one of the crankshafts rotates; a footskate, the footskate capable of reciprocating movement on the rail; an adjustment arm, the adjustment arm connected to the frame at a second rotational axis, spaced from the first rotational axis, the adjustment arm being operationally attached to the footskate via an interface located toward the distal end of the adjustment arm so that reciprocation of the adjustment arm through a second arc segment is translated into the reciprocating movement of the footskate, and a coupler connecting the adjustment arm to the pendulum arm so that when the pendulum arm reciprocates about the first rotational axis, the adjustment arm is forced to reciprocate about the second rotational axis; the coupler being spaced a first distance from the first axis and a second distance from the second axis, wherein, at least one of the first distance and the second distance is variable, In an embodiment of the machine, the second distance is variable and may be varied by moving the second rotational axis relative to the frame while keeping the coupler fixed relative to the frame. The movement may be accomplished by an adjustment mechanism which may be, but is not limited to, an electrically powered device, a hand powered device, or a worm screw.

In an embodiment of the machine, at least one of the crankshafts is attached to a flywheel or a resistance device. A computer may be used to control the machine such as by controlling the resistance device and the adjustment mechanism.

In an embodiment of the machine, at least one of the crankshafts includes a wheel and an offset pin, the offset pin being rotationally connected to a drive link; the drive link being operatively connected to a rocker bar such that: rotation of the wheel causes the drive link to reciprocate which in turn causes the rocker bar to reciprocate, which in turn causes the pendulum arm to reciprocate, In an embodiment of the machine the position of the rail at any selected point of rotation, is parallel to the position of the rail at any other selected point of rotation.

There is also disclosed herein, a method of altering the stride length of an elliptical exercise machine during an exercise, the method comprising: providing an elliptical exercise machine; the machine including: a frame; at least two crankshafts rotationally connected to the frame; a rail attached to the crankshafts so that the rail traverses a path in conjunction with the rotation of the crankshafts; a pendulum arm, connected to the flame at a first rotational axis to the flame, and operatively connected to at least one of the crankshafts such that the pendulum arm reciprocates within a first arc segment as the at least one of the crankshafts rotates; a footskate, the footskate capable of reciprocating movement on the rail; an adjustment arm, the adjustment arm connected to the frame at a second rotational axis, spaced from the first rotational axis, the adjustment arm being operationally attached to the footskate via an interface located toward the distal end of the adjustment arm so that reciprocation of the adjustment arm through a second arc segment is translated into the reciprocating movement of the footskate; and a coupler connecting the adjustment arm to the pendulum arm so that when the pendulum arm reciprocates about the first rotational axis, the adjustment arm is forced to reciprocate about the second rotational axis; the coupler being spaced a first distance from the first axis and a second distance from the second axis; having a user exercise on the elliptical exercise machine; and adjusting the second distance while the user is exercising.

BRIEF DESCRIPTION OF THE DRAWINGS

FIG. 4 shows a detail view of the crankshafts. FIG. 4A shows the front crankshaft while

FIG. 5 shows the embodiment of FIG. 2 positioned for two different stride lengths FIG. 5A is a short stride length, while

FIG. 6 shows a general diagram indicating motion of the pendulum arms to the adjustment arms at a first distance between the axes. FIG. 6A shows the forward position while

FIG. 7 shows a general diagram indicating motion of the pendulum arms to the adjustment arms at a second distance between the axes. FIG. 7A shows the forward position while

DESCRIPTION OF PREFERRED EMBODIMENT(S)

Although the machines, devices, and methods described below are discussed primarily in terms of their use with a particular layout of an elliptical exercise motion machine utilizing two rotational crankshafts and handgrip pendulum arms, one of ordinary skill in the art would understand that the principles, methods, and machines discussed herein could be adapted, without undue experimentation, to be useable on an elliptical motion machine which generates its elliptical motion through the use of other systems.

The invention disclosed herein primarily relates to elliptical exercise machines where a reciprocating footskate which traverses a fixed linear portion of a main drive link is replaced by a system where the linear traversal is adjustable during an exercise to allow for quick and convenient alteration of the horizontal stride length of the user utilizing the machine, without significantly altering their vertical stride height on the machine, For the purposes of this disclosure, the terms horizontal and vertical will be used when referring to the dimensions of the ellipse drawn by the user's feet. One of ordinary skill in the art will understand that depending on the arrangement of the parts and how the machine is used, the ellipse traversed by the user's feet may be at an angle to the vertical and horizontal. That is, a line connecting the two axes of the ellipse may not be completely horizontal or completely vertical, or in some cases it may be. For the purposes of this disclosure, when the horizontal dimension of the ellipse is referred to, it is referring to the longest dimension of the ellipse (line through both axes), and the vertical dimension is the shortest dimension of the ellipse (line evenly spaced between the two axes) These dimensions are not used to strictly mean horizontal and vertical relative to the earth. Further, most of this discussion will refer to the operation of a single side of an exercise machine, one of ordinary skill in the art would understand that the other side will operate in a similar manner.

Further, while the system discusses elliptical motion, it should be recognized that that term, as is used in the art of exercise machines, does not require the foot of the user to traverse a true ellipse, but that the foot of the user traverses a generally elliptical Or similar rotational shape,. The shape will generally not be circular, but may be circular, oval, elliptical, in the shape of a racetrack, kidney-shaped, or in any other shape having a relatively smoothly curving perimeter with a horizontal and vertical component of movement.

Figure 1:
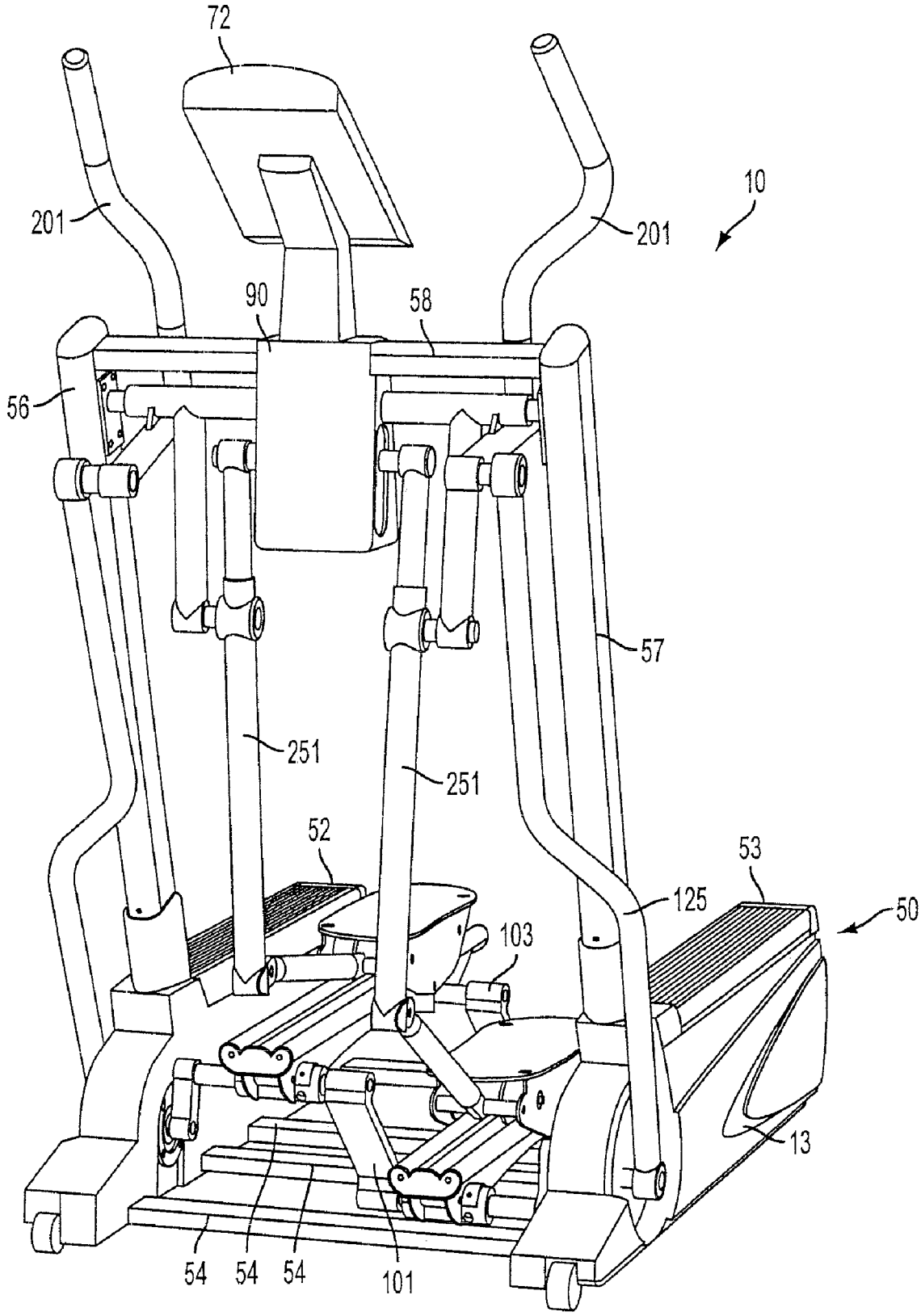
FIG. 1 shows a front perspective view of an embodiment of a compact exercise machine with adjustable stride length with the frame cover in place.

FIG. 1 depicts an embodiment of a compact elliptical motion exercise machine (10) including an adjustable stride length of the type that may be adjusted during the exercise. The exercise machine (10) is comprised of a frame (50) of generally rigid construction which will sit stably on a surface to provide for the general shape of the machine (10) as shown in FIG. 1. The frame (50) is generally constructed of strong rigid materials such as, but is not limited to, steel, aluminum, plastic, or any combination of the above. The frame (50) may be of any shape, but will generally be designed to provide a place to attach the remaining components and to provide a structure which can resist damage or breakage from repeated use by the individual exercising thereon. The frame (50) will also generally be designed so as to stably support a user utilizing the exercise machine (10) and prevent the machine from having undue sway or other undesirable motion while the user is exercising. In the depicted embodiment, frame (50) includes three major substructures, left and right main supports (52) and (53), crossbeams (54), and vertical riser beams (56) and (57).

The main supports (52) and (53) will generally rest on the surface upon which the exercise machine (10) is placed This surface will generally be flat. One of ordinary skill in the art would understand that the surface need not be flat as the position of the machine is only important relative to the user but, for clarity, this disclosure will presume that the machine is placed on a generally flat surface. The main supports (52) and (53) are then held at a position spaced apart from each other by the crossbeams (54). There may be any number of crossbeams and the depicted number of four by no means required. The vertical riser beams (56) and (57) extend generally away from the surface on which the machine is resting and generally extend from the main supports (52) and (53) at a point around the front of the frame (50). The vertical riser beams (56) and (57) will generally be topped by a top crossbeam (58) which may have attached thereto a computer control panel (72) for controlling the functions of the machine (10) as known to those of ordinary skill in the art.

The top crossbeam (58) may have additional uses from simply supporting the computer control panel (72). In particular, the top crossbeam (58) may be used to support the user's hands during exercising if they do not wish to utilize the exercise arms (201). Still further, the adjustment mechanism (90), which is discussed in detail later, may be attached to the top crossbeam (58) in a central location. This attachment provides for a simplified mechanism for adjusting the second axis (223) as the axes for both adjustment arms (251) may be arranged at a central point, allowing a single adjustment mechanism (90) to simultaneously operate on both.

In an embodiment, the frame (50) may include additional components, or not include any of the above components. Further, any portion of the frame (50) may be covered by a cover (13) as shown in FIG. 1 which may not provide for specific strength and support of the other components of the machine (10), but may serve to cover operating or moving parts of the machine (10) for aesthetic or safety purposes such as to keep an individual's clothing from becoming trapped in the machine (10) or simply to give the machine a particular "look,"

Figure 2:
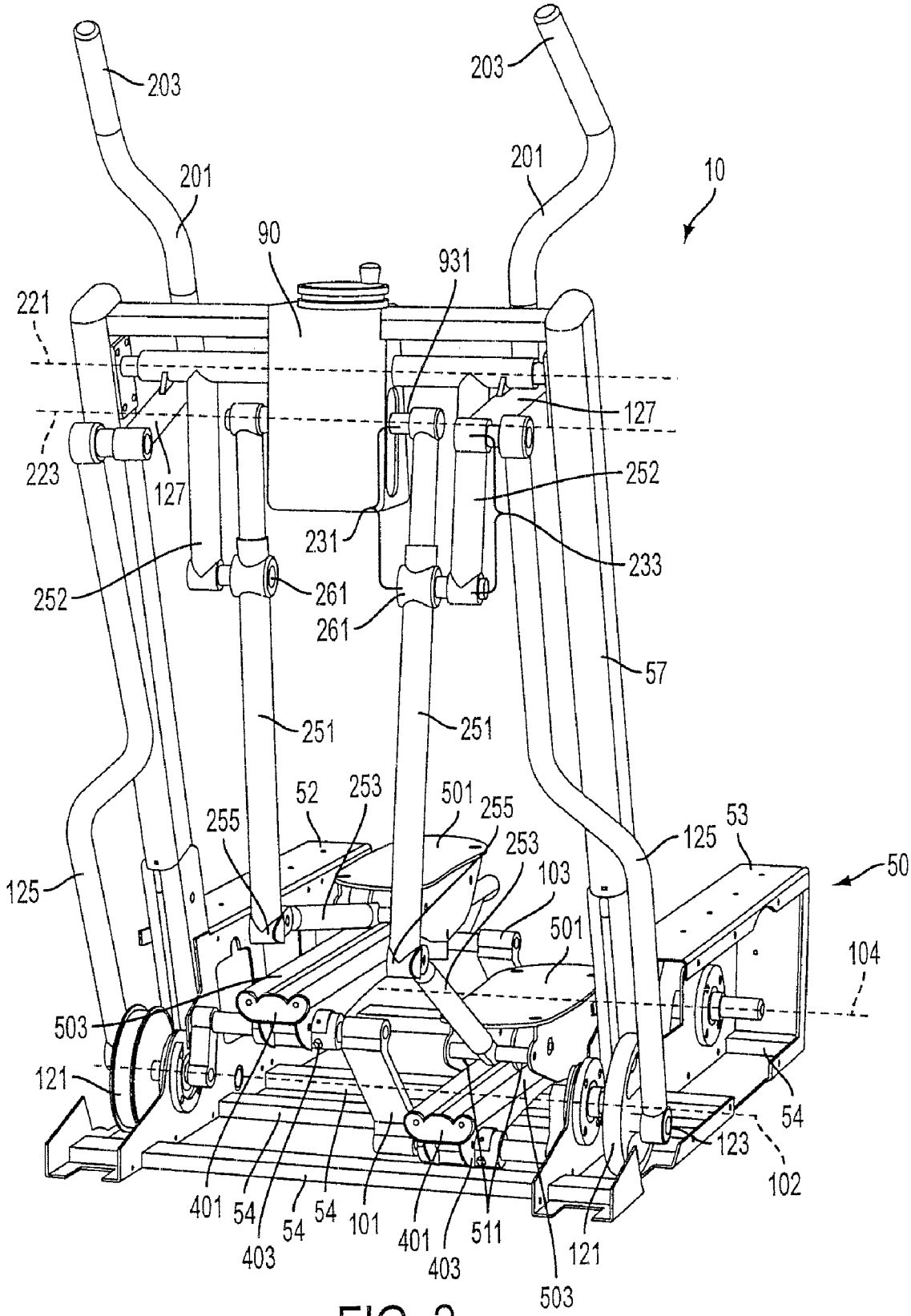
FIG. 2 shows the embodiment of FIG. 1 with the cover removed.
Figure 3:
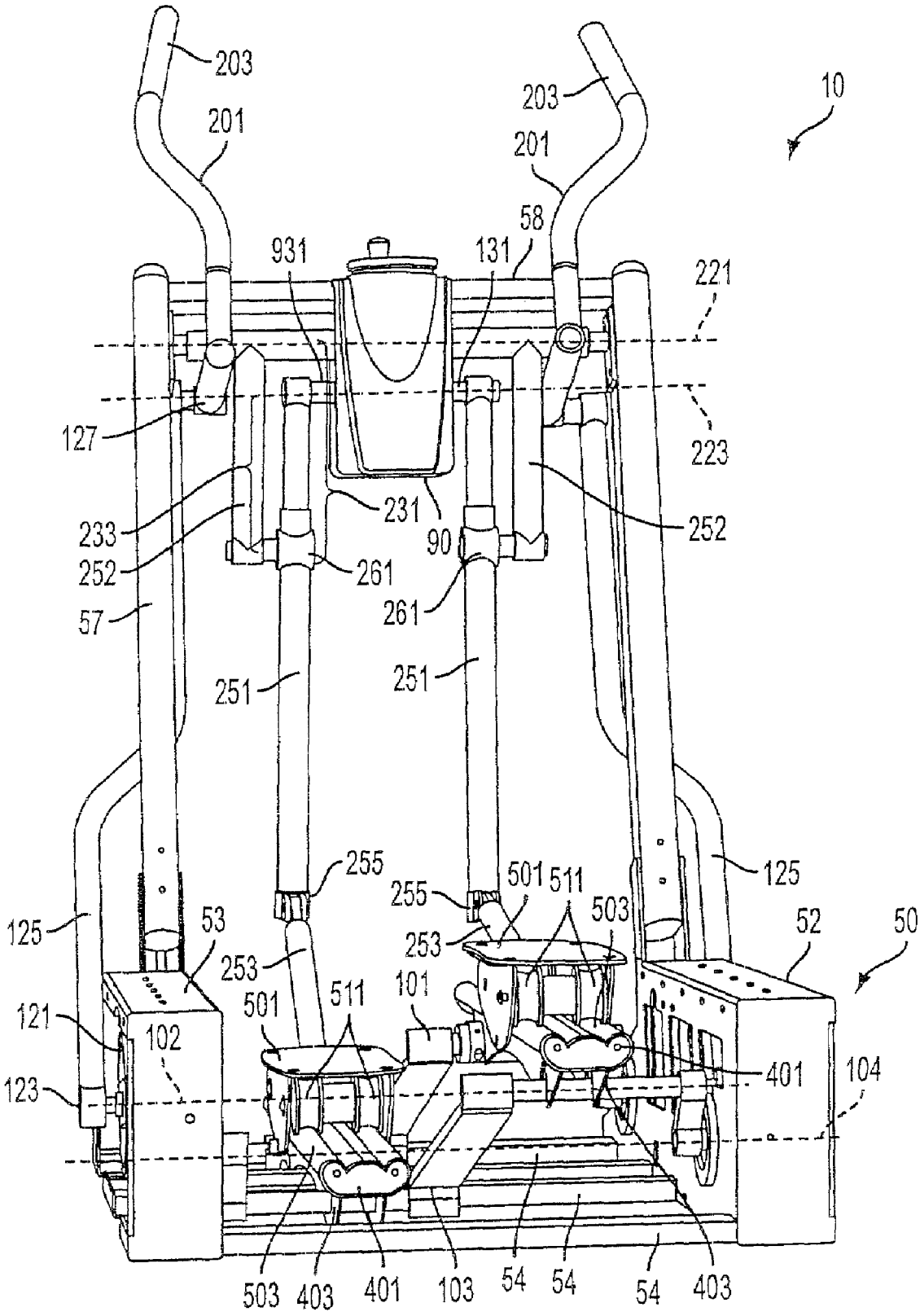
FIG. 3 shows a rear perspective view of the embodiment of FIG. 2
Figure 4A:
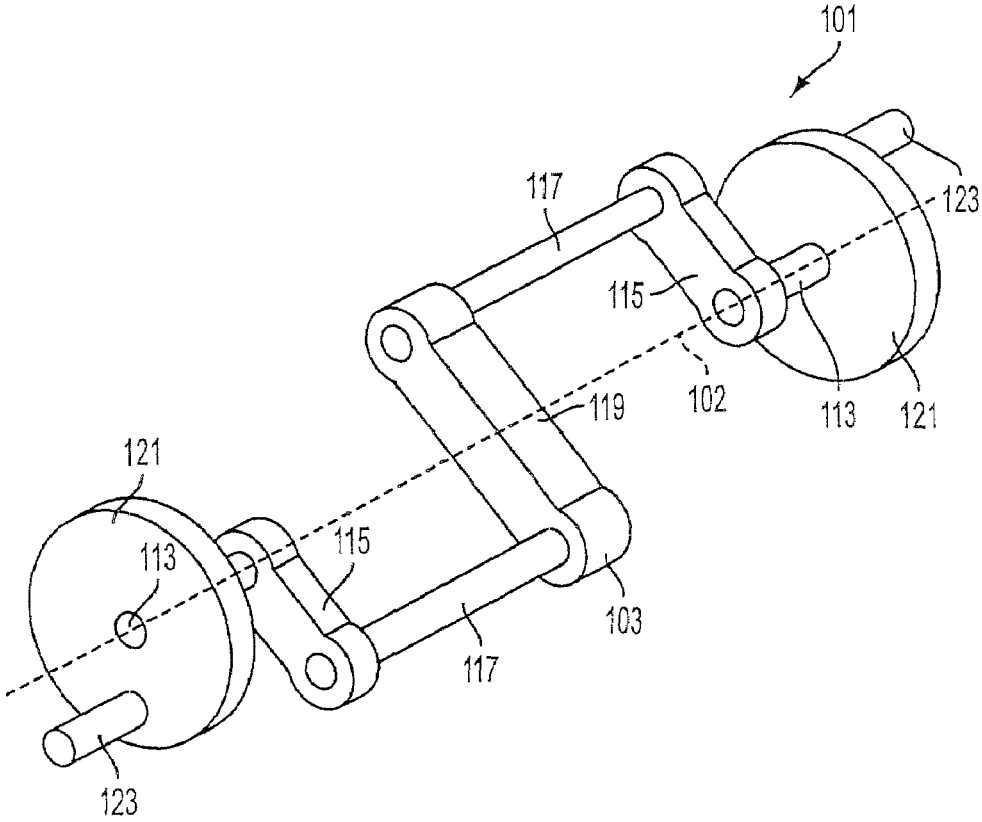

FIGS. 2 and 3 show various views of the frame (50) with the cover (13) removed so that internal parts are visible. Attached between the main support beams (52) and (53) are a pair of crankshafts (101) and (103). The front crankshaft (101) is arranged generally toward the front of the machine (10) while the rear crankshaft (103) is arranged toward the rear. Front and rear are arbitrarily assigned, but relate generally to the user's usual facing when using the exercise machine (10). Each crankshaft (101) and (103) rotates relative to the frame (50) about a central axis (102) and (104) as is best seen in the depiction of the crankshafts (101) and (103) shown in FIG. 4. On the front crankshaft (101), there is a wheel (121) attached at each end which will rotate in conjunction with the rotational motion of the front crankshaft (101). The crankshaft (101) or (103) will be attached to the frame (50) through bearing assemblies around the axial portions (113) of the crankshaft (101) or (103).

Figure 4B:
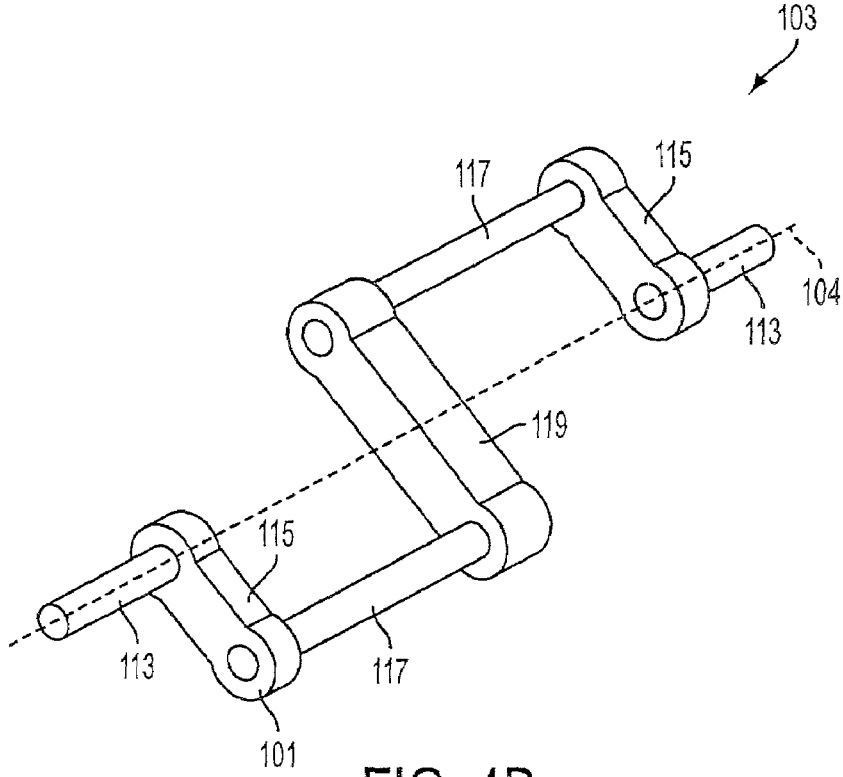
FIG. 4B shows the rear.

Turning back to FIG. 4 and the front crankshaft (101), the front crankshaft (101) comprises the axial portions (113) of the shaft, two crank arms (115) which are generally 180 degrees separated, two crank pins (117), each of which is arranged generally parallel to the axis of rotation of the crankshaft (101), and a connecting web (119) between the two crank pins (117) The resultant design of crankshaft (101) therefore has the two crank pins (117) arranged generally 180 degrees out of phase with each other. The rear crankshaft (103) as shown in FIG. 4B will generally have a similar arrangement of axial portions (113), crank aims (115), crank pins (117) and connecting web (119). The remaining structure of the rear crankshaft (103) will, however, be different in most cases as various components need only interact directly with one of the crankshafts.

Attached towards the ends of the axial portions (113) of the front crankshaft (101) is a wheel (121) Each wheel (121) has attached thereon an offset pin (123) which is arranged at a distance from the center of rotation of the wheel (121) to which it is attached. The offset pin (123) on the left side of the machine (10) will generally be arranged so as to be at a position 180 degrees different from the offset pin (123) on the right side of the machine (10) at any given time. Further, the offset pin (123) will generally be arranged to "trail" the rotation of the associated crank pin (117) (that is the crank pin (117) on the left side on the machine (10) for the offset pin (123) on the left side of the machine (10)) about 60 degrees when the crankshafts (101) and (103) are rotated in their generally forward direction.

Each of these offset pins (123) is attached to a drive link (125) which will extend from the pin (123) upward to a rocker bar (127). The rocker bar (127), is attached via a rotational connection to a point upward on the vertical riser (56) or (57). Therefore, as the front crankshaft (101) rotates in the generally forward direction, the wheel (121) rotates with the crankshaft (101) and causes the offset pin (123) to rotate in a continuous circle. As the offset pin (123) rotates, the drive link (125) will generally cause the rocker bar (127) to rock back and forth through a fixed portion of an arc.

Attached to the rocker bar (127) is an exercise arm (201). The exercise arm (201) will generally comprise two portions, the upper portion or handgrip (203) and the lower pendulum arm (252). Both portions will generally be rigidly attached both to each other and to the rocker bar (127) so as to move as a unit. The hand grip (203) at the top of the exercise arm (201) generally moves in a vertically arranged arc segment. This handgrip (203) is designed to be grasped by a user and can be used to help exercise the user's arms and to drive the motion of the crankshafts (101) and (103).

In operation, the two crankshafts (101) and (103) are preferably placed in the frame (50) in such a manner that they are rotating at a similar relative position. That is, the crank pin (117) on the right side of the front crankshaft (101) is in the same arcuate position as the crank pin (117) on the right side of the rear crankshaft (103) at any instant in time. This arrangement is what is depicted in FIGS. 1 through 3 and provides that each of the rails (401), which is arranged to be attached simultaneously to both the same side crank pins (117) of both crankshafts (101) and (103), will move in a pattern whereby it is parallel to its position at any other time during rotation. This arrangement is not, however, required, and in an alternative embodiment, the crankshafts (101) and (103) are placed to be slightly out of phase with each other. If placed out of phase, the rails (401) will perform a levering motion about a central pivot point as the crankshafts (101) and (103) rotate.

The two same side crank pins (117) on the crankshafts (101) and (103), as discussed above, are each connected by a rail (401). The rail (401) is attached to the appropriate crank pin (117) toward the similar end of the rail (401) through a support pivot (403) The support pivot (403) provides a single axis of rotation relative to each of the crankshafts (101) and (103) and allows the rail (401) and the crank pin (117) to freely rotate about each other at that axis of rotation. As the crankshafts (101) and (103) are connected by the rails (401), it should be apparent that as each of the crankshafts (101) and (103) moves through the circle of rotation, the rails (401) force the other of the crankshafts (101) and (103) to move through the circle at a similar rate. Still further, any point on either rail (401) transcribes a circle at the same time that each of the crank pins (117) transcribes a circle. The two crankshafts (101) and (103) are therefore arranged to operate in simultaneous rotational position. Further, due to the design of the crankshafts (101) and (103), the two rails (401) will be essentially arranged to rotate 180 degrees out of phase with each other.

As the crankshafts (101) and (103) transcribe the circle moving the rails (401) through circles, the front crankshaft (101) will turn the wheels (121), which will, in turn, cause the pendulum arms (201) to reciprocate. By placing the user's feet directly on the rails (401), the user will be able to exercise with the machine (10) with their feet transcribing circular motion in a constantly parallel position. This circular motion may be made elliptical by providing a footskate (501) which will slide on the rail (401) at a particular rate related to the instantaneous position of the rail (401). Such sliding motion allows for alteration of the travel path from that of a circle to one approaching an ellipse. Traditionally, this elliptical motion was provided in a fixed fashion whereby the reciprocation of the rocker bar's (127) was simply transferred to the footskates (501) by the distal end of the pendulum arms (252). One such arrangement of components is shown in U.S. Pat. No. 6,835,166, the entire disclosure, of which is herein incorporated by reference, In addition to providing the basic rotational motion to the footskates (501), the crankshafts (101) and (103) may also additionally operate on other components to provide for additional functionality in the exercise machine (10) For example, the front crankshaft (101) may turn a sprocket (not shown) which is connected to one axial portion (113) thereof. The sprocket in turn is connected to a chain (not shown) or other synchronization device, such as, but not limited to, a connecting rod, which connects between the front sprocket and a rear sprocket which is attached to the rear crankshaft (103) at a similar axial portion (113). The rotation of the chain about the sprockets can further help to maintain synchronicity in the movement of the two crankshafts (101) and (103) by allowing the motion of one crankshaft (101) or (103) to be translated to the other crankshaft (101) or (103). This can supplement the rails (401) translation of motion from one crankshaft (101) or (103) to the other and help maintain synchronicity.

There may also be included a variety of other components as is known to those of ordinary skill in the art for improving exercise motion upon which at least one of the crankshafts (101) or (103) interacts. For example, the wheel (121) or another wheel on either crankshaft (101) or (103) may be connected to a flywheel (not shown) by means of a belt (not shown) so as to provide for more fluid and smooth motion of the rails (401) as the crankshafts (101) and (103) are rotated and the pendulum arms (201) are reciprocated. The inclusion of such a flywheel is well known to those of ordinary skill in the art and allows for the storage of inertial energy so that once the rails (401) have begun to rotate, the rotation is maintained in a smooth fashion.

Further, there may be a resistance device (not shown) included to provide for resistance to the motion of the wheel (121) and therefore to increase the difficultly of the exercise. The resistance device may comprise a friction belt which serves to resist the rotation of the wheel (121). As the belt is tightened on the wheel (121), the amount of force required to move the wheel (121) (and to maintain its steady rotation) is increased providing for a more difficult exercise. This design of resistance device is by no means required, however, and any type of resistance device, including but not limited to, friction devices, electromechanical devices, pneumatic or hydraulic devices, or a combination of devices may be used to provide resistance.

While not shown, the exercise machine (10) may also include an electric drive or electric assist mechanism. While the exercise motion preferably uses motion of the arms and legs of the user to drive the crankshafts (101) and (103) through their desired motion as the provision of exercise, it is recognized that in some cases, a user may lack the requisite strength to commence the exercise or to comfortably perform it. Such an assistance mechanism for use in conjunction with arm driven treadmills, which could be adapted for use with this elliptical machine (10), is shown in U.S. patent application Ser. No. 60/613,661, the entire disclosure of which is herein incorporated by reference.

As discussed above, so as to provide for elliptical instead of circular motion of the user's foot, each of the rails (401) has located thereon a footskate (501) which is arranged to reciprocate on a foot track (503) which is located on the rail (401). The reciprocating relationship may be accomplished by any mechanism known to those of ordinary skill in the art including sliding or rolling relationships. In the depicted embodiment, the footskate (501) includes a series of wheels (511) which roll on the foot track (503) as depicted. In the depicted embodiment the adjustable motion is accomplished by the inclusion of an adjustment arm (251) connected via a transfer arm (253) attached toward the distal end (255) of adjustment arm (251) to the front of the footskate (501). The adjustment arm (251) is rocked in a pendulum motion by the action of a coupler (261) which is located a first distance (231) from the first axis of rotation (221) of the pendulum arm (252). The coupler (261) is also attached a second distance (233) from the second axis of rotation (223) about which the adjustment arm (251) rotates. So as to provide for adjustment to the stride distance during the exercise, at least one of the first distance (221) and second distance (223) is adjustable, as will be discussed in more detail later.

Figure 5A:
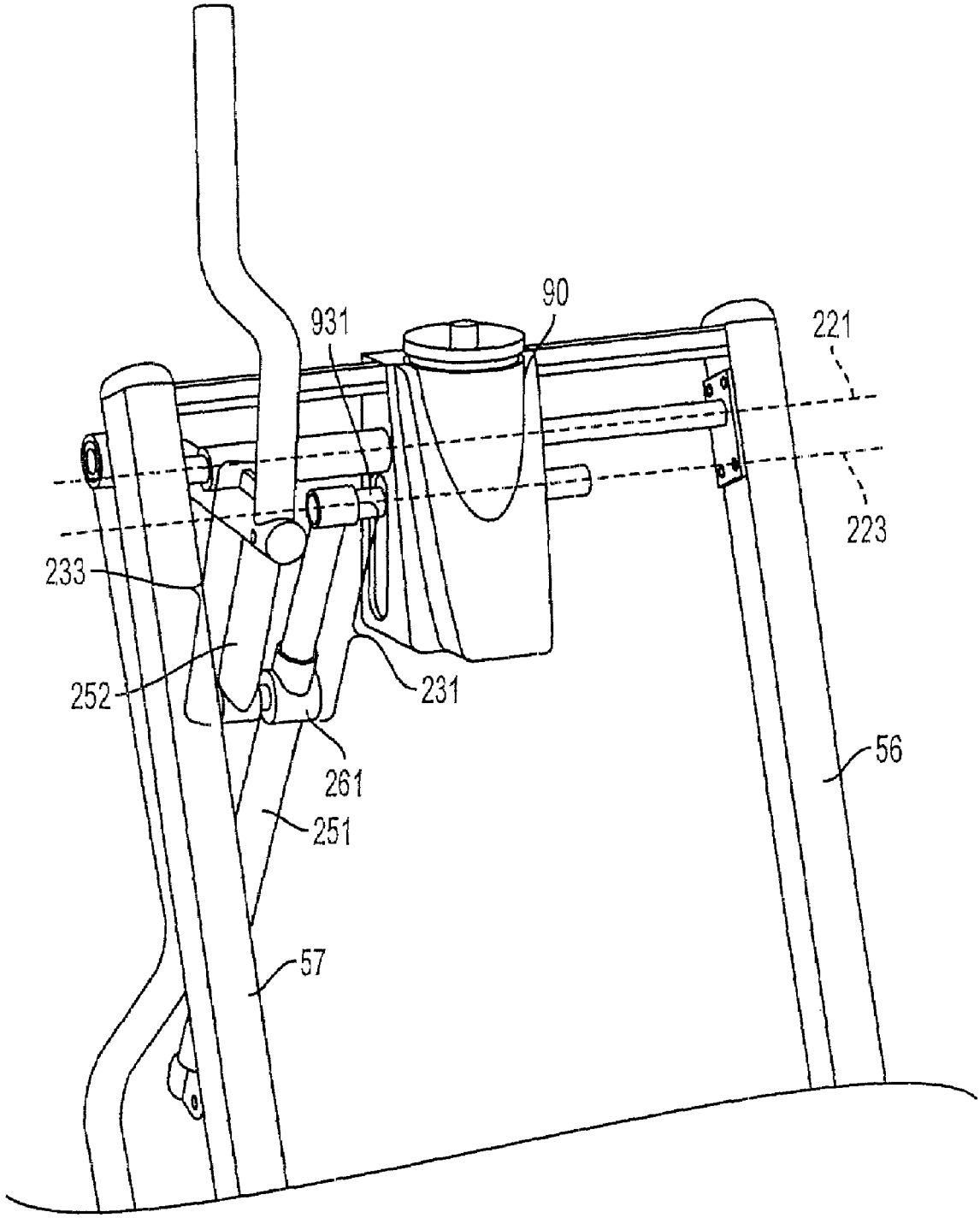
Figure 5B:
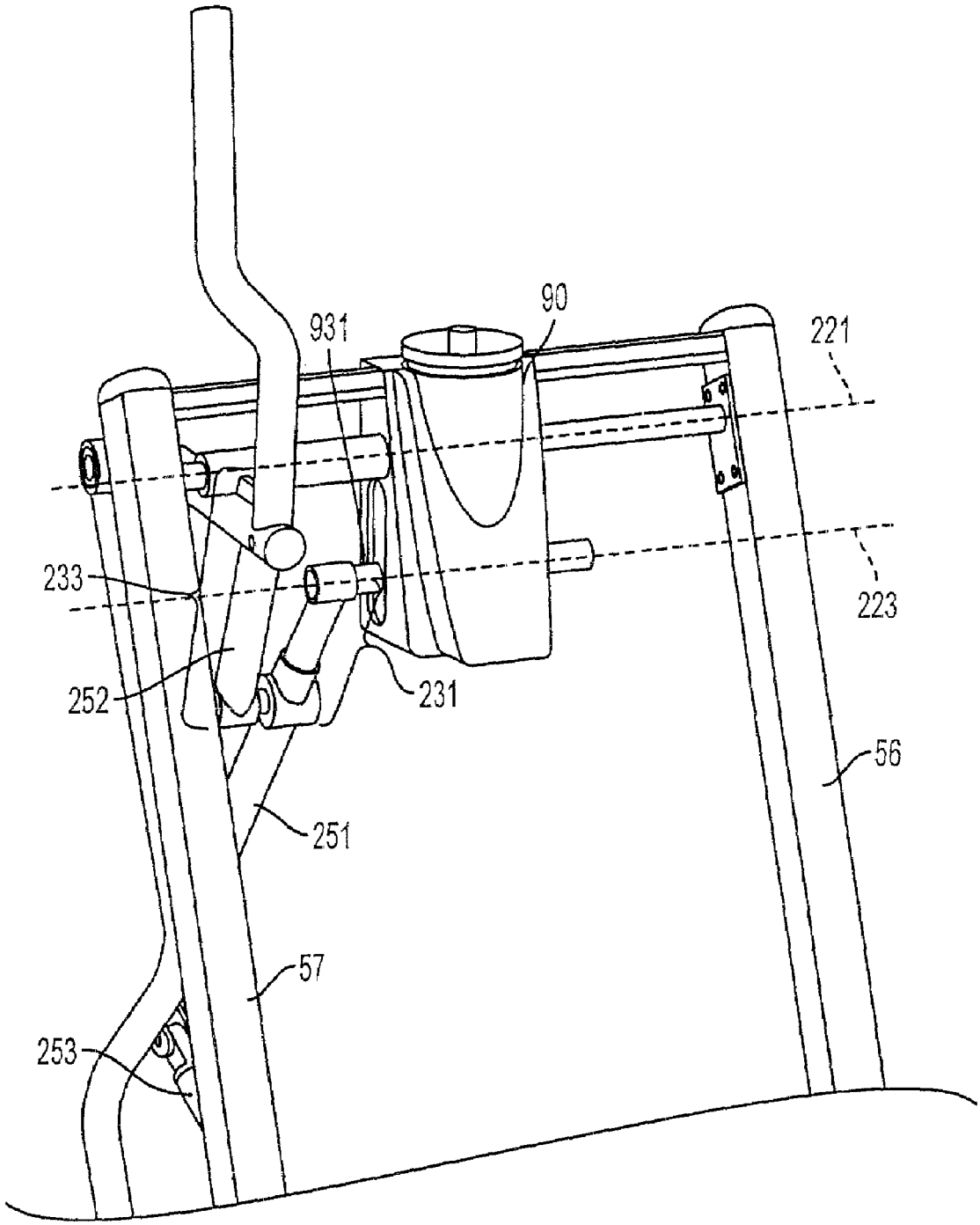
FIG. 5B is a long stride length.
Figure 6A:
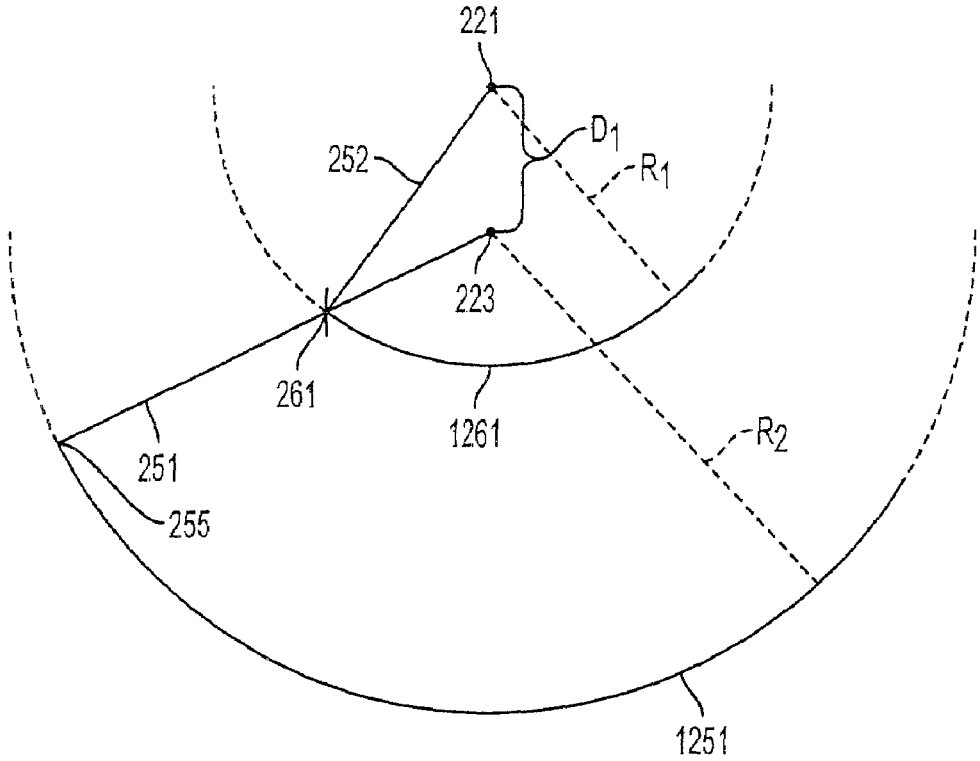
Figure 6B:
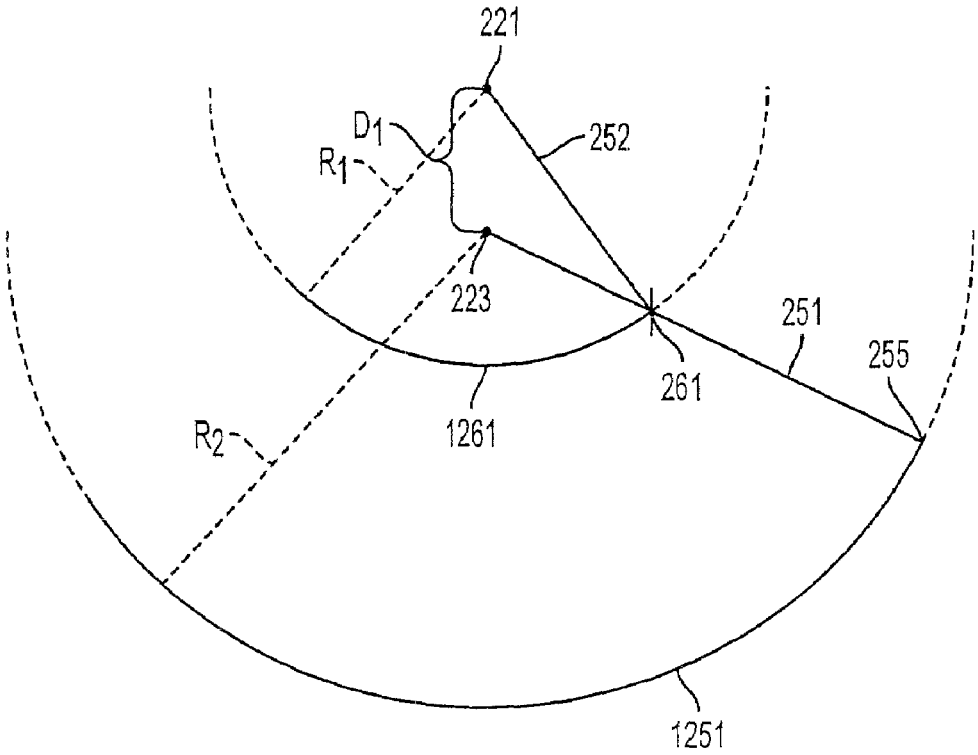
FIG. 6B shows the rearward.
Figure 7A:
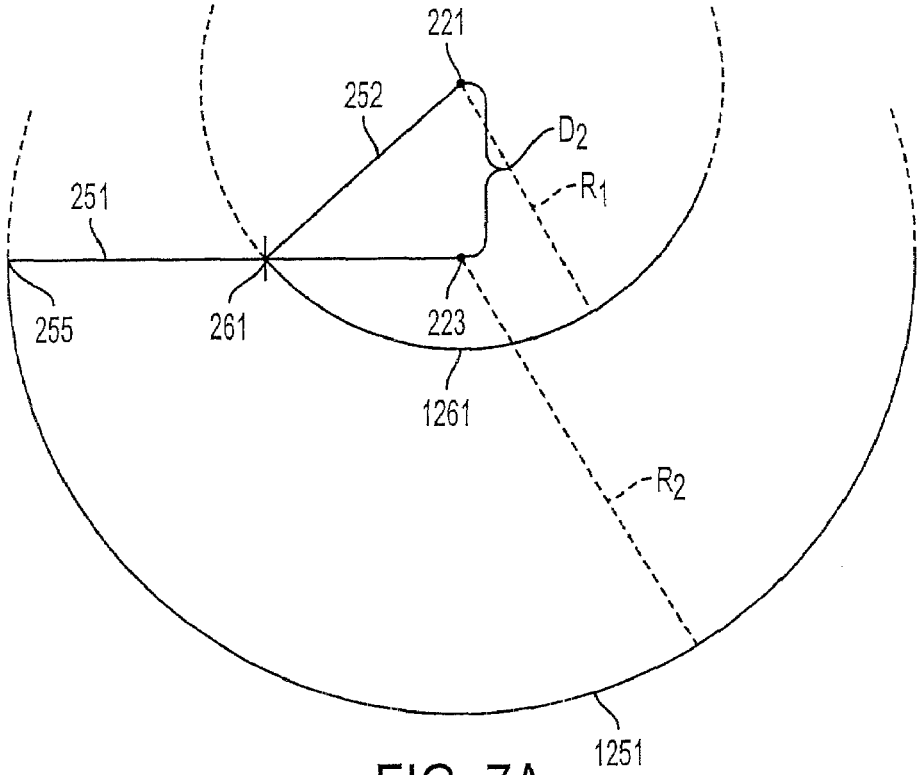
Figure 7B:
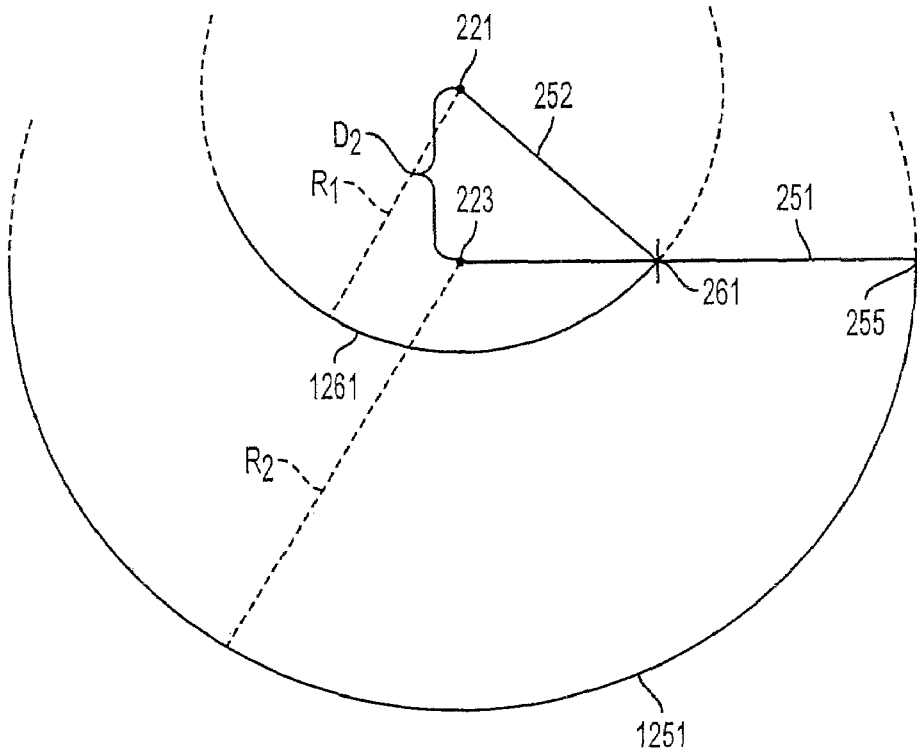
FIG. 7B shows the rearward.

To understand the motion imparted to the footskate (501) and how to adjust that motion, it is best to begin generally with a particular value of the first distance (231) and second distance (233) chosen, this is best seen by examining FIGS. 5 through 7. As the pendulum arm (252) reciprocates due to the front crankshaft (101), the motion of the pendulum arm (252) is translated to the adjustment arm (251) via the coupler (261). The placement of the coupler (261) spaced from the second axis of rotation (223) forces the adjustment arm (251) to reciprocate in a related fashion relative to the second axis (223). The motion, however, will generally be altered by the relative position of the first axis (221) to the second axis (223) and the second axis (223) to the coupler (261), The adjustment arm (251) is attached so as to rotate about a second axis of rotation (223). This second axis of rotation (223) is physically created in the depicted embodiment by rotational attachment of the proximal end of the adjustment arm (251) to the rotational bar (931) which is attached to the adjustment mechanism (90). The second axis of rotation (223) is preferably parallel to and spatially separated from the first axis of rotation (221) about which the pendulum arm (252) rotates. While spatial separation could be in any direction, it is preferable that the axes be vertically separated and be arranged so that the second axis of rotation (223) is located within the area traversed by the pendulum arm (252). It is more preferred that the second axis (223) be located vertically displaced from the first axis of rotation (221) so as to be below the first axis of rotation. It is still more preferred that the second axis (223) be essentially below the first axis (221) so as to simplify the motion relationship between the pendulum arms (201) and adjustment arms (251) Such an arrangement is depicted in FIGS. 5 through 7 as it allows the pendulum arms (201) and adjustment arms (251) to simultaneously have horizontal motion in the same direction. This correspondence generally makes it easier to maintain reinforcement of the rotational movement of the crankshaft (101) or (103) by horizontal movement of the footskate (501). With a non-vertical arrangement, the same modifications can still be accomplished, but the interrelationship becomes unnecessarily complicated.

FIGS. 6 and 7 demonstrate the relationship of the motion of the pendulum arm (252) to the adjustment arm (251). The motion relates because of the percentage of arc length, and the actual arc length traversed by distal end (255) of the adjustment arm (251), compared to the coupler (261). As shown in the FIGS., the coupler (261) helps to dictate the relationship due to its positioning below both the first axis (221) and second axis (223). As can be seen from FIG. 6, the coupler (261) comprises a rotational pivot allowing both the pendulum arm (252) and the adjustment arm (251) to rotate about their individual axes (221) and (223) respectively, while the coupler (261) also serves to transfer rotational motion from one of the two arms, but at a different rate. The two arms, however, rotate through different arc segments. The coupler (261) will generally be located at a fixed distance from one of the two axes (221) or (223). At least one axis of rotation will be arranged, however, so as to be moveable relative to the coupler (261). In the depicted embodiment, the second axis (223) is moveable while the first axis (221) is fixed. As this movement occur's, the second distance (233) is therefore either shorted or lengthened, FIGS. 6 and 7 show together how this can affect the motion of the adjustment arm (401). In FIG. 6 there is shown two circles. The first circle (1261) has a radius of $R_1$ while the second circle (1251) has a radius of $R_2$ where $R_2$ is greater than RI. Further the axis of circle (1261) is vertically transposed above the axis of the circle (1251) by a distance D. The circle (1251) corresponds to the path of the distal end of the adjustment arm (251) while the circle (1261) corresponds to the path of the coupler (261) At the instant shown in FIG. 6A there is a line drawn to each of the circles representing the portion of the pendulum arm (252) above the coupler (261) and the adjustment arm (251). As you can see at the forward position of FIG. 6A, the coupler (261) has rotated through a certain arc segment as indicated by the portion of the circle (1261) in solid line form. Further, the rotation of the coupler (261) has effectively forced the distal end (255) of the adjustment arm (251) to traverse a greater arc as shown by the portion of circle (1251) in solid line. In effect, due to arcuate motion of each portion about a different axis, and the interaction of the coupler (261) to the structure of the two different parts, the coupler (261) is increasing the amount of rotation traversed by the distal end (255) of the adjustment arm (251) over what it would traverse if the second axis (223) of rotation was coaxially arranged with the first axis (221). Of particular importance, the distal end (255) of the adjustment arm (251) has moved a greater distance horizontally, which is the component of motion which will be transferred to the footskate (251), than it would have moved had it been rotating about the first axis (221), Comparing FIG. 6 to FIG. 7, as the distance between the second axis and the coupler (261) decreases, the horizontal length traced by the adjustment aim (251) will increase with the same arcuate distance traversed by the pendulum arm (252). Obviously, when moving in the opposite direction, the opposite is true. A comparison of FIG. 6 to FIG. 7 shows how the amounts of arc traversed by the distal end (255) of the adjustment arm (251) (and the vertical and horizontal components of that traversal) changes based on the location of coupling (261) or second axis (223). In this case the second axis (223) is moved to a greater distance $D_2$ from the first axis (221). It should be apparent that the movement of the second axis (223) is not required to adjust the horizontal distance. In an alternative embodiment, the coupler (261) may be moved instead. A related effect can also be achieved by moving the first axis (221) while holding the second axis (223) and coupler (261) in position. This, however, generally requires a more complicated relationship to provide similar motion.

As should be clear from the simplified drawings of FIGS. 6 and 7, the dual arm arrangement shown in FIGS. 1 through 3 allow for the footskate (501) to be provided with an alterable reciprocation on the main drive link (401) by adjustment of the relative spacing of the second axis (223) and coupler (261). In particular, as the second axis (223) and coupler (261) are moved together, the amount of horizontal distance traversed by the distal end (255) of the adjustment aim (251) necessarily increases FIG. 5 shows an embodiment of the movement and its effect on the extreme position of the footskate (501) using a partial view of the machine (10) of FIGS. 1 through 3.

The result of this adjustment is to alter the stride length of the exercise. This is accomplished by altering the distance of reciprocation of the footskate (501) without altering the underlying motion of the main drive link (401). It is, therefore, desirable to include structure to implement such transfer There is included a transfer arm (253), which serves to transfer the horizontal component of the adjustment arm's (251) reciprocation to the footskate (501). The transfer arm (253) is rotationally connected between the distal end (255) of the adjustment arm (251) and to the footskate (501) in a manner such that some of the adjustment arm's (251) motion is translated to the footskate (501) As should be apparent, as the reciprocation of the pendulum arm (252) is directly related to the rotation of the front crankshaft (101), and the reciprocation of the pendulum arm (252) is in turn related to the reciprocation of the adjustment arm (251) which is in turn related to the translation of the footskate (501), the footskate (501) will oscillate on the main drive link (401) in a relatively fixed timing relationship with the rotation of the front crankshaft (101) Therefore, the system can provide for a relationship of translation related to the position of motion of the front crankshaft (101). To put this another way, for any selected instant along the rotation of the front crankshaft (101), the instantaneous motion of the footskate (501) is the same regardless of the number of times the rotation is repeated.

With appropriate timing, the reciprocation of the footskate (501) may complement the motion of the main drive link (401) to increase the horizontal dimension of the ellipse, or may work against the reciprocating motion of the main drive link (401) to decrease the horizontal dimension of the ellipse In the latter case, it may even be possible to rotate the major dimension of the ellipse to be in the vertical direction by making the horizontal reciprocation smaller than the original circular radius. In particular, if one were to select a particular fixed point, the reciprocating motion of the footskate (501) allows the user's foot to traverse a distance across that fixed point so that the user's foot has always moved a particular distance relative to the fixed point for a particular location on the ellipse. As the default motion of the footskate (501) in a fixed position is a circle, the interrelationship will generally be selected so as to have the reciprocation work constructively with the horizontal component of the rotation. In this way, the horizontal movement component of the main drive link (401) at any moment is in the same instantaneous direction as the horizontal component of the adjustment arm (251).

This reciprocating motion of the adjustment arm (251), provides for an arrangement that provides for elliptical as opposed to circular motion for the user's feet. At the same time, once this relationship is determined (which is generally based on the positioning of the offset pin (123)), the adjustment mechanism allows the length of the exercise to become adjustable.

This design provides for an adjustable horizontal stride distance without a corresponding increase in vertical stride height during the exercise by allowing adjustment of the relative position of the second axis (253) relative to the coupling (261). This adjustment may occur by either moving the coupling (261) or by moving the second axis (223) as both types of motion are equivalent. As the crankshaft (101) and (103) motions are not altered, the vertical dimension of the exercise is not altered.

To adjust the dimensions of the exercise in the embodiment of FIGS. 1 through 3, the machine (10) of the depicted embodiment provides for adjustment of the position of the second axis (223) as shown in FIG. 5. In particular, as can be seen in the detail views of FIG. 5, the second axis (223) is provided as part of an adjustment mechanism (90). This may be any type of adjustment mechanism (90) but in the preferred embodiment is designed to be a rotational bar (931) which provides a linkage to the adjustment arm (251) and defines the second axis (223). The rotational bar (931) is adjustably mounted to the frame. Generally, movement of the rotational bar (931) relative to the flame is accomplished by a hydraulic or pneumatic piston, worm screw, linear adjuster, or other translation device (935) which is in turn powered by an electric or other engine (not shown). The engine may be powered by electricity generated by the user's performance of the exercise, or may be from an external source. In an alternative embodiment, the adjustment mechanism (90) may include a hand crank, may be physically lifted by the user between different predetermined positions, or may comprise locking points for the rotational bar (931) to be moved by physical lifting of the user, or may be moved by any other type of lift mechanism (90) known now or later discovered Movement of the rotational bar (931) relative to the flame will serve to move the second axis (233) both relative to the frame (50) and either closer to or further away from the coupler (261) as the coupler (261) is in fixed positional relationship to the flame (50) This allows the user to adjust the stride length. To keep the relationships simpler, the adjustment mechanism (90) will generally move the bar within a vertical linear path, but that is by no means required The adjustment mechanism (90) can be used by the machine (10) in conjunction with the exercise being performed to provide for "on the fly" adjustment of the stride. This in-exercise adjustment allows for increased functionality of the machine (10), comfort for the user, and control over the available exercise options.

In an embodiment, the machine (10) will utilize the adjustable stride via the control panel (72) which will be used to select exercise characteristics. Generally, the user will preselect a program of exercise which corresponds to various different types of motion to be performed according to a pattern, over time, and the control panel (72) will adjust the stride length and resistance device to provide for different types of comfortable motion at different times in the exercise program.

In particular, the user may start off with a warm up period of light walking, then go into an alternating period of fast running and slower climbing, and then end with a period of slower cool down. The device can create this exercise by beginning with a period of intermediate stride length at a relatively low speed of rotation and low resistance. This would conform more to a quick walk. The user can then be instructed to speed up the stride and as the user's stride begins to accelerate, the machine can adjust the stride length to be longer and lower the resistance. Further, as the length is increasing, the user will naturally wish to adopt a more comfortable, and faster, motion. This would conform more to a running motion. The user can then be instructed to slow up their stride as the machine starts to decrease the stride length and in fact may reduce the stride length to a more circular motion while increasing the resistance. This provides for a more of a climbing motion As the user enters the cool down section, the stride length can again be adjusted more toward the middle stride length or walking motion again.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. An elliptical exercise machine comprising:

a frame;

a crankshaft rotationally connected to said frame;

a rail attached to said crankshaft so that said rail traverses a path in conjunction with the rotation of said crankshafts;

a pendulum arm, connected to said frame at a first rotational axis to said frame, and operatively connected to said crankshaft such that said pendulum arm reciprocates within a first arc segment as said crankshaft rotates;

a footskate, said footskate capable of reciprocating movement on said rail;

an adjustment arm, said adjustment arm connected to said frame at a second rotational axis, spaced from said first rotational axis, said adjustment arm being operationally attached to said footskate via an interface located toward the distal end of said adjustment arm so that reciprocation of said adjustment arm through a second arc segment is translated into said reciprocating movement of said footskate; and a coupler connecting said adjustment arm to said pendulum arm so that when said pendulum arm reciprocates about said first rotational axis, said adjustment arm is forced to reciprocate about said second rotational axis; said coupler being spaced a first distance from said first axis and a second distance from said second axis;

wherein, at least one of said first distance and said second distance is variable.

2. The machine of claim 1 wherein said second distance is variable.

3. The machine of claim 2 wherein said second distance is varied by moving said second rotational axis relative to said frame while keeping said coupler fixed relative to said frame.

4. The machine of claim 3 further comprising an adjustment mechanism for moving said second rotational axis relative to said flame.

5. The machine of claim 4 wherein said adjustment mechanism is electrically powered.

6. The machine of claim 4 wherein said adjustment mechanism include a worm screw.

7. The machine of claim 4 wherein at least one of said crankshafts is attached to a flywheel.

8. The machine of claim 4 wherein at least one of said crankshafts is attached to a resistance device.

9. The machine of claim 8 further comprising a computer to control said machine.

10. The machine of claim 9 wherein said computer can control said resistance device and said adjustment mechanism.

11. The machine of claim 4 wherein said adjustment mechanism is hand powered.

12. The machine of claim 1 wherein said crankshaft includes a wheel and an offset pin, said offset pin being rotationally connected to a drive link; said drive link being operatively connected to a rocker bar such that:

rotation of said wheel causes said drive link to reciprocate which in turn causes said rocker bar to reciprocate; which in turn causes said pendulum arm to reciprocate.

13. The machine of claim 1 wherein the position of said rail at any selected point of rotation, is parallel to the position of said rail at any other selected point of rotation.

14. The machine of claim 1 wherein said crankshaft is a first crankshaft, and wherein said machine further comprises a second crankshaft rotationally connected to said frame and attached to said rail so that said rail traverses a path in conjunction with the rotation of said first crankshaft and said second crankshaft.

15. The machine of claim 14 wherein said rail comprises a first end, a second end, and a length therebetween;

wherein said first crankshaft is attached at said first end; and wherein said second crankshaft is attached at said second end.

16. A method of altering the stride length of an elliptical exercise machine during an exercise, the method comprising:

providing an elliptical exercise machine; the machine including:

a frame;

a crankshaft rotationally connected to said frame;

a rail attached to said crankshaft so that said rail traverses a path in conjunction with the rotation of said crankshafts;

a pendulum arm, connected to said frame at a first rotational axis to said frame, and operatively connected to said crankshaft such that said pendulum arm reciprocates within a first arc segment as said crankshaft rotates;

a footskate, said footskate capable of reciprocating movement on said rail;

an adjustment arm, said adjustment arm connected to said frame at a second rotational axis, spaced from said first rotational axis, said adjustment arm being operationally attached to said footskate via an interface located toward the distal end of said adjustment arm so that reciprocation of said adjustment arm through a second arc segment is translated into said reciprocating movement of said footskate; and a coupler connecting said adjustment arm to said pendulum arm so that when said pendulum arm reciprocates about said first rotational axis, said adjustment arm is forced to reciprocate about said second rotational axis; said coupler being spaced a first distance from said first axis and a second distance from said second axis;

having a user move said footskate; and adjusting said second distance while said user is moving.

17. The method of claim 16 wherein said crankshaft is a first crankshaft, and wherein said machine further includes a second crankshaft rotationally connected to said frame and attached to said rail so that said rail traverses a path in conjunction with the rotation of said first crankshaft and said second crankshaft.

18. The method of claim 17 wherein said rail comprises a first end, a second end, and a length therebetween;

wherein said first crankshaft is attached at said first end; and wherein said second crankshaft is attached at said second end.

* * * * *